US007393050B2

(12) United States Patent
Li

(10) Patent No.: US 7,393,050 B2
(45) Date of Patent: Jul. 1, 2008

(54) FOLDABLE STRUCTURE OF HIGHCHAIR

(75) Inventor: Wei-Yeh Li, Tainan County (TW)

(73) Assignee: Link Treasure Limited, Tortola (VG)

( * ) Notice: Subject to any disclaimer, the term of this patent is extended or adjusted under 35 U.S.C. 154(b) by 0 days.

(21) Appl. No.: 11/504,696

(22) Filed: Aug. 16, 2006

(65) Prior Publication Data

US 2007/0040420 A1 Feb. 22, 2007

(30) Foreign Application Priority Data

Aug. 17, 2005 (TW) ..... 94214064 U

(51) Int. Cl.
*A47D 1/02* (2006.01)
*A47B 83/02* (2006.01)
*A47C 4/00* (2006.01)

(52) U.S. Cl. ..... 297/148; 297/149; 297/150; 297/153; 297/154; 297/16.1

(58) Field of Classification Search ..... 297/148, 297/149, 150, 153, 154, 16.1
See application file for complete search history.

(56) References Cited

U.S. PATENT DOCUMENTS 1,587,253 A * 6/1926 Tarbox ..... 297/154 X
1,621,930 A * 3/1927 Sew Hoy ..... 297/154
1,943,037 A * 1/1934 Overbey ..... 297/154 X
2,284,498 A * 5/1942 Tucker ..... 297/154 X
2,383,127 A * 8/1945 Howe ..... 297/150 X
2,473,991 A * 6/1949 Felsher ..... 297/150 X
2,517,004 A * 8/1950 Little et al. ..... 297/149 X
2,627,300 A * 2/1953 Wohler et al. ..... 297/154 X
2,699,817 A * 1/1955 Adler et al. ..... 297/153 X
2,852,068 A * 9/1958 Rossi ..... 297/149 X
2,973,804 A * 3/1961 Gill ..... 297/149 X
3,012,815 A * 12/1961 Smith ..... 297/153 X
3,345,105 A * 10/1967 Levy et al. ..... 297/149 X
4,536,026 A * 8/1985 Cornell ..... 297/39
4,693,510 A * 9/1987 Marchesini ..... 297/39
5,054,848 A * 10/1991 Liu ..... 297/39
5,507,550 A * 4/1996 Maloney ..... 297/153
5,707,104 A * 1/1998 Perego ..... 297/16.1
5,707,105 A * 1/1998 Liu ..... 297/16.1 X
5,735,570 A * 4/1998 Tseng ..... 297/39
5,964,500 A * 10/1999 Lin ..... 297/16.1
6,095,596 A * 8/2000 Chen ..... 297/39
6,126,236 A * 10/2000 Wu ..... 297/148 X (Continued)

FOREIGN PATENT DOCUMENTS

GB 2260485 A * 4/1993 ..... 297/150

*Primary Examiner*—Rodney B. White
(74) *Attorney, Agent, or Firm*—Muncy, Geissler, Olds & Lowe, PLLC

(57) ABSTRACT

Disclosed is a foldable structure of highchair, the structure includes a slidable folding sleeve arranged at a rear leg and provided with a locking block; the locking block locks with a locking portion of a linking rod connected between the rear leg and seat so as to be in a fixed state for retaining expanded position of the structure. The folding sleeve is moved by users to disengage from the locking portion of the linking rod, so that the linking rod drives the rear, front leg and the seat to rotate relatively in order to draw close to one another to be in a folded state for achieving the goal of easy operation of the present invention.

12 Claims, 6 Drawing Sheets

U.S. PATENT DOCUMENTS 6,129,414 A * 10/2000 Brevi ..... 297/16.1
6,161,898 A * 12/2000 Brevi ..... 297/150 X
6,206,462 B1 * 3/2001 Huang ..... 297/39
6,347,830 B1 * 2/2002 Chen ..... 297/16.1
6,517,151 B2 * 2/2003 Liu ..... 297/16.1
6,692,070 B1 * 2/2004 Hou et al. ..... 297/153
6,854,800 B2 * 2/2005 Perego ..... 297/148
6,877,801 B2 * 4/2005 Asbach et al. ..... 297/153 X
7,029,064 B2 * 4/2006 Chen ..... 297/16.1
2007/0029845 A1 * 2/2007 Riedl et al. ..... 297/16.1

* cited by examiner

FOLDABLE STRUCTURE OF HIGHCHAIR

This application claims priority of Application No. 094214064 filed in Taiwan on Aug. 17, 2006 under 35 U.S.C. § 119, the entire contents of which are hereby incorporated by reference.

FIELD OF THE INVENTION

The invention relates to a foldable structure of highchair and, in particular, to a structure that is able to fix or fold a chair after expanding through a slidable folding sleeve.

DESCRIPTION OF THE PRIOR ART

Highchairs are usually used as a dining apparatus for children. The structures of the conventional highchair may be referred to U.S. Pat. Nos. 5,435,620, 4,958,885, 5,509,719, 5,348,374, 5,507,550, 5,806,922, 5,829,826, 5,927,805, 5,951,102 and 6,010,184. The highchair structure generally consists of a chair portion and a leg portion that erects the highchair above the ground. The highchair is usually equipped with a food tray.

The common forms for the legs of the highchairs are generally categorized in a stationary form, such as those disclosed in U.S. Pat. Nos. 5,806,922 and 5,927,805, or an expandable form, such as those disclosed in U.S. Pat. Nos. 5,507,550 and 5,951,102, in which two of the legs are connected to the same location and the bottoms of the legs may be expanded at an angle for supporting the highchair above the ground, or an inclined form, such as those disclosed in U.S. Pat. Nos. 5,509,719, 5,435,620 and 4,958,885, in which the legs include a first leg horizontally lying over the ground, and a second leg having a first end connected to the first leg and assuming an inclined angle with respect to the first leg. The leg that is horizontally laid over the ground may also be categorized into a stationary form (such as U.S. Pat. No. 5,509,719), an assembled form (such as U.S. Pat. No. 5,435,620) and a foldable form (such as U.S. Pat. No. 4,958,885), wherein the fixed form is unfoldable such that it will occupy a relatively large area in storage, the assembled form allows disassembly of the highchair in storage but is inconvenient as it requires repeated assembly and disassembly, and the foldable form allows easy folding operations upon drawing the first leg close to the second leg. However, the folding mechanism disclosed in U.S. Pat. No. 4,958,885 is relatively complicated.

SUMMARY OF THE INVENTION

In order to resolve the above-mentioned problem, the present invention provides a foldable structure of highchair. According to the present invention, a slidable folding sleeve is disposed at rear leg of the structure; the slidable folding sleeve has a locking block, which engages with locking portion of a linking rod arranged between the rear leg and a seat, so that the structure can be fixed after expanding by positioning effect resulted from the engagement. While folding the structure, user can move the folding sleeve to disengage the locking block from the locking portion of the linking rod, whereby the linking rod can drive the rear, front leg and the seat to rotate and draw close relatively.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
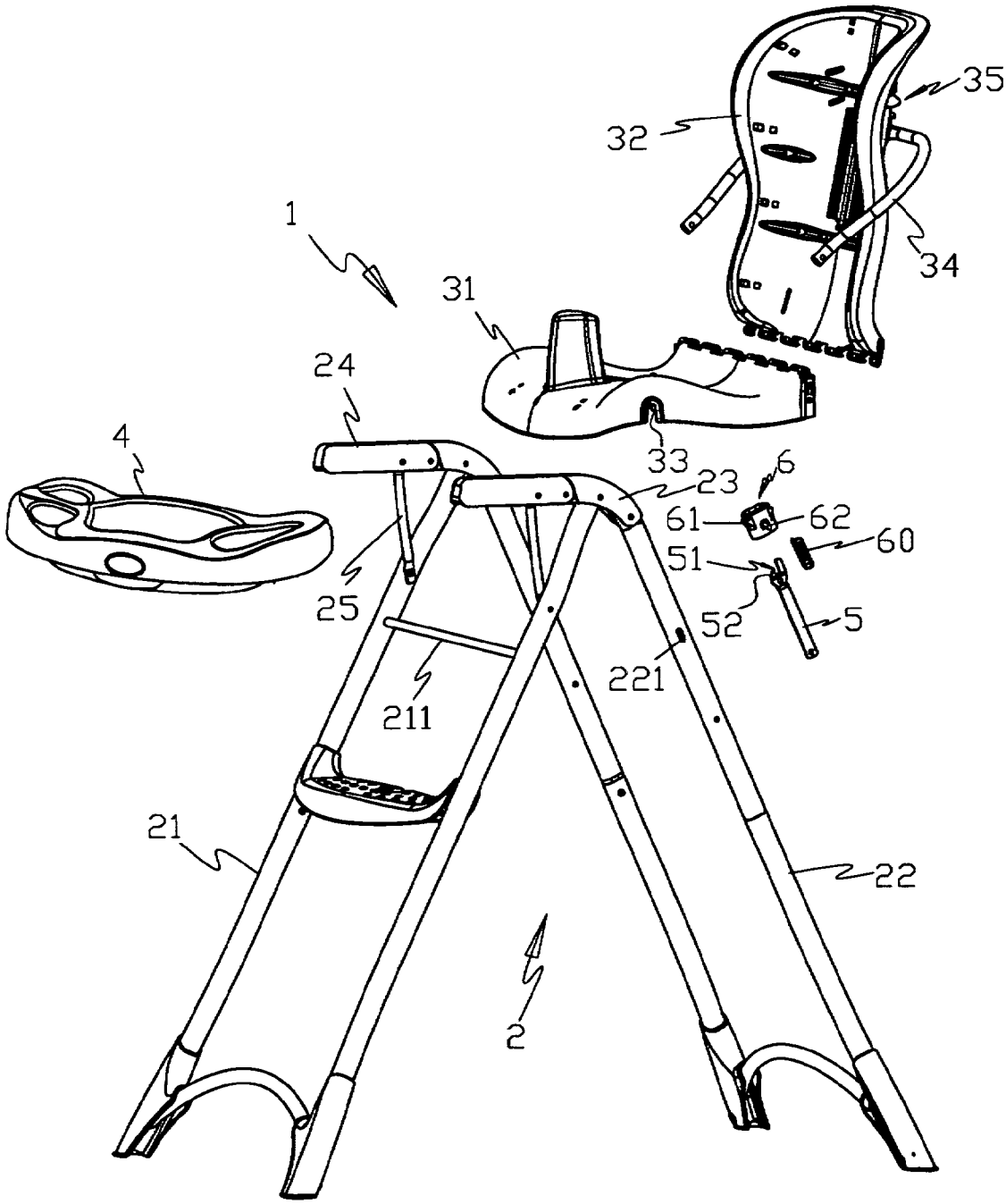
FIG. 1 is a perspective view of the foldable structure of the present invention.
Figure 2:
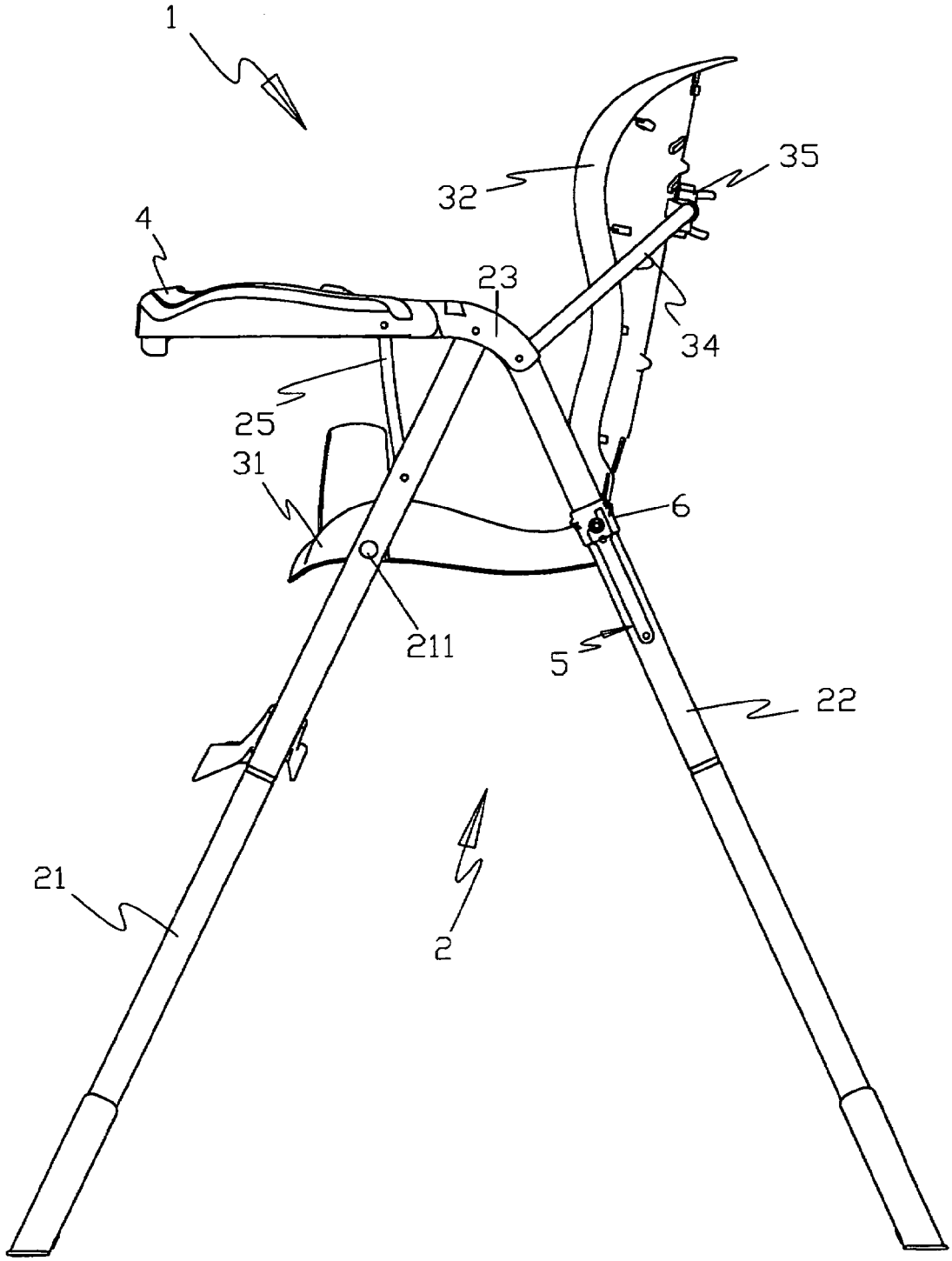
FIG. 2 is a side view of the foldable structure of the present invention after expanding.

Shown in FIGS. 1~2 is an embodiment of the foldable structure 1 of highchair of the present invention with compact size and easy for storage. The structure 1 includes a foldable supporter 2, a seat 3, a food tray 4, a linking rod 5 and a folding sleeve 6.

Wherein the foldable supporter 2 comprises a front leg 21, a rear leg 22 and a receiving base 23, the front and rear legs 21, 22 are each configured to a U-like shape. In the present invention, the pivoting base 23 is connected to upper ends of the front and rear legs 21, 22, so that the front and rear legs 21, 22 can be expanded relatively in a fixed angle, and also pivotally connect to the seat 3; therefore, the front and rear legs 21, 22 can rotate according to the connecting place and draw close to each other. In the present invention, a transverse rod 211 is disposed between two sides of the front leg 21, and a slot 221 is disposed at the rear leg 22. In addition, the pivoting base 23 is pivoted to the connecting base 24, the tray is arranged on the connecting base 24, and a folding rod 25 is connected between the connecting base 24 and the front leg 21. While linking together by the folding rod 25, the structure 1 expands and the front leg 21 supports the tray 4; and when the structure 1 is folded, the folding rod 25 pulls the connecting base 24 by moving front leg 21 to fold the tray downwardly.

The seat 3 includes a seat portion 31 and a backrest 32, wherein the seat portion 31 is pivoted to backrest 32. In the present invention, a pivoting portion 33 is arranged at side of the seat portion 31 in order to pivot with the transverse rod 211 of the front leg 21. In addition, a back supporter 34 is pivoted between the backrest 32 and the pivoting base 23 as well as connects to a backrest-adjusting device 35, whereby the backrest adjusting device 35 of the backrest 32 can adjust rotational angle of the back supporter 34 and furthermore to control and support the inclination of the backrest 32.

Figure 3:
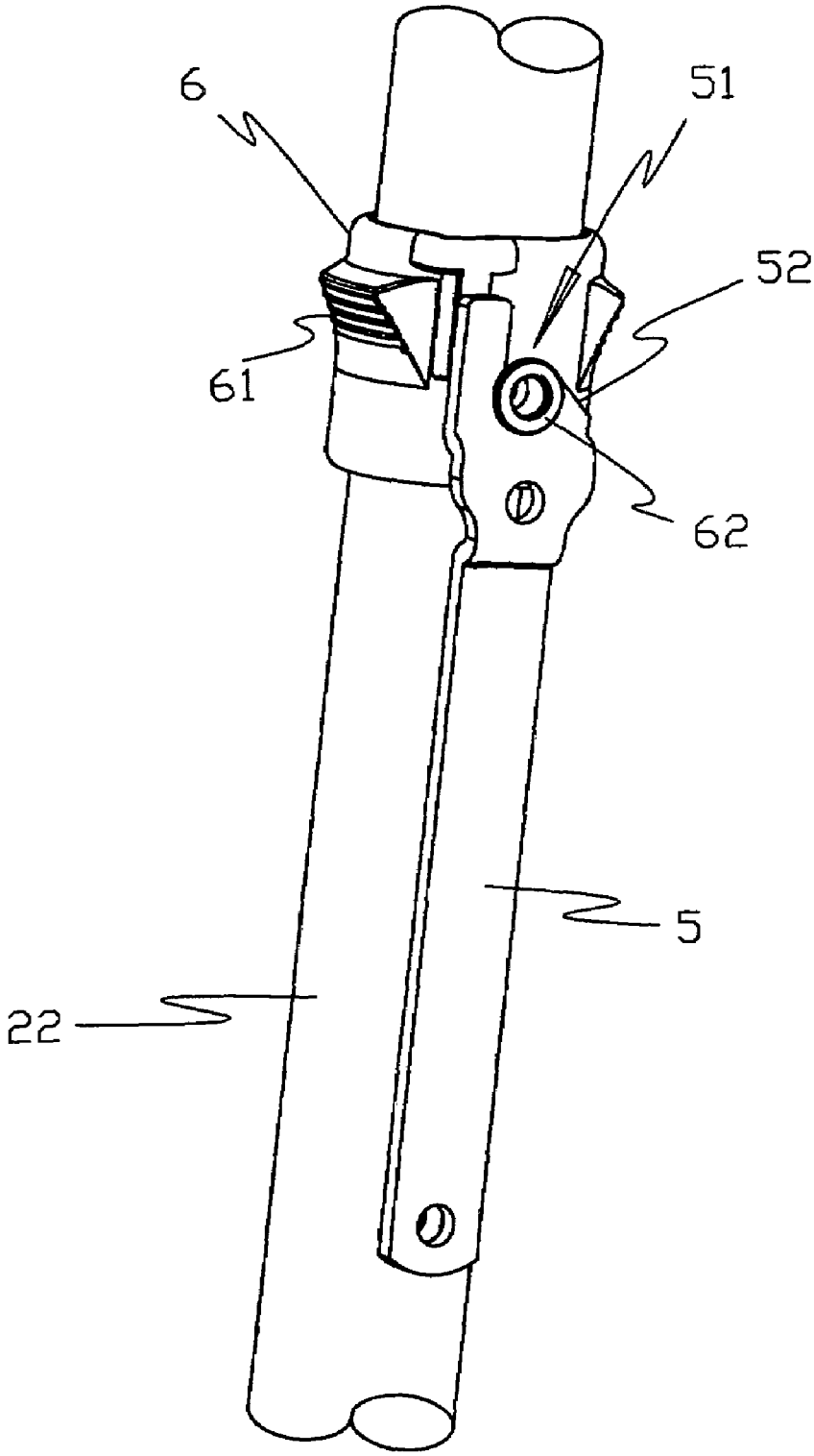
FIG. 3 is a schematic view showing the engagement of the linking rod with the locking block of the present invention.
Figure 4:
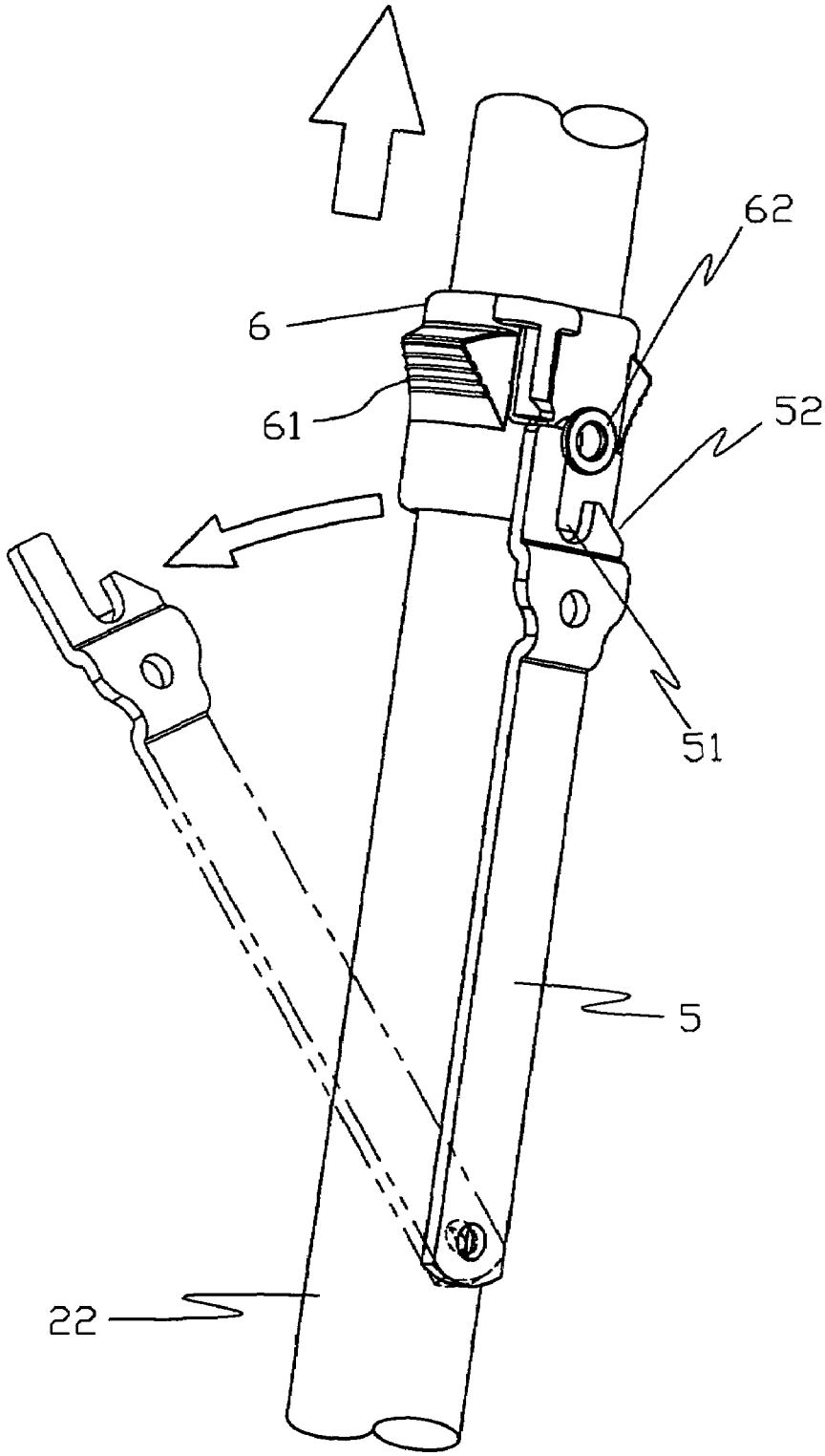
FIG. 4 is a schematic view showing the disengagement of the linking rod with the locking block of the present invention.

Referring to FIGS. 3 and 4, one end of the linking rod 5 pivots to the rear leg 22, and the other end pivots to one side of the seat portion 31. Also, the seat portion 31 is pivoted between the front leg 21 and the linking rod 5 so as to rotate and fold the seat portion 31 since the front and rear legs 21, 22 are draw close to each other while folding the structure 1. In addition, a locking portion 51 is disposed at one end of the linking rod 5. In the present invention, the locking portion 51 is a notch and a slope 52 is arranged outside the notch.

Figure 5:
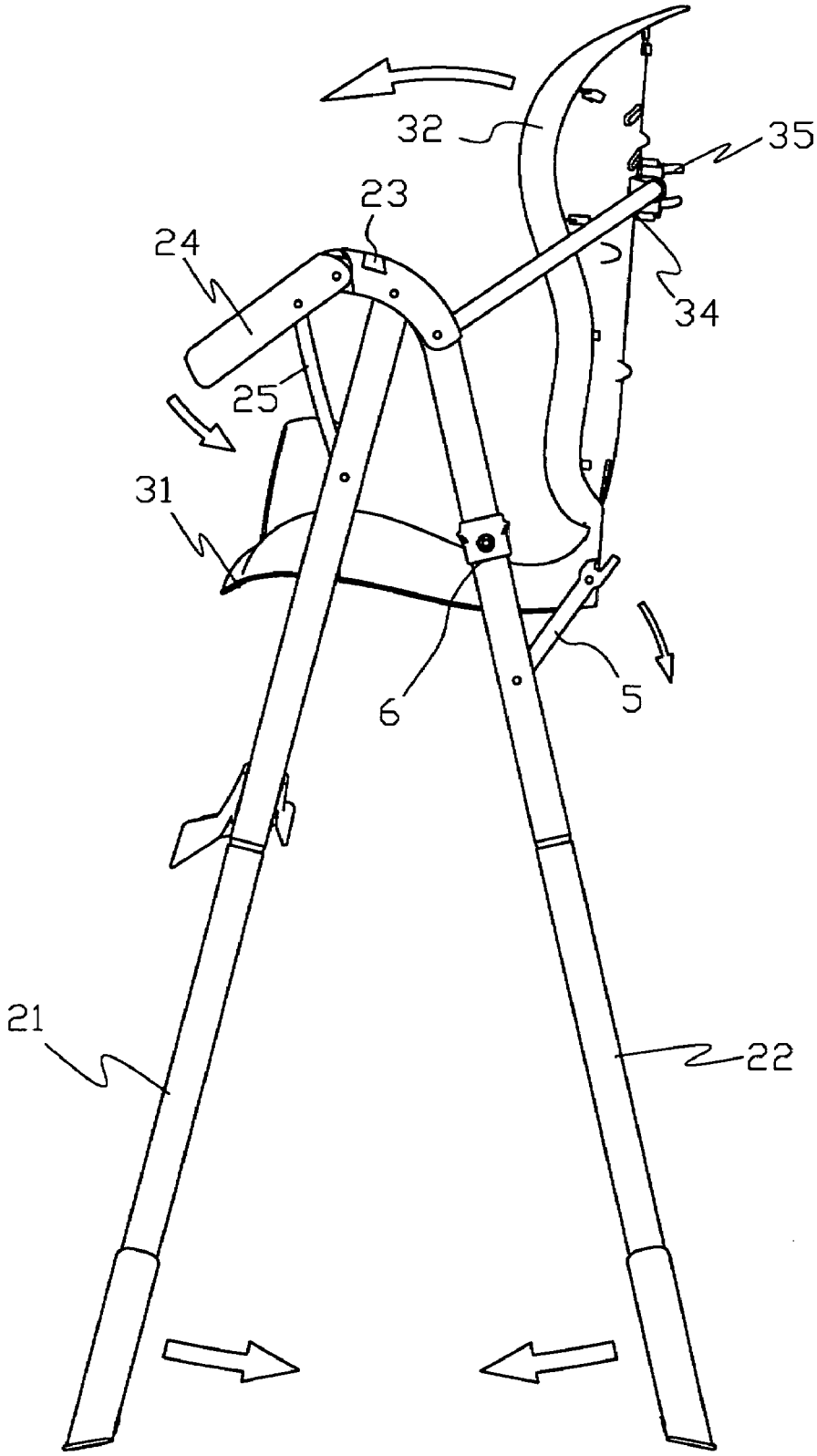
FIG. 5 is a schematic view showing the movement of folding the foldable structure of the present invention.
Figure 6:
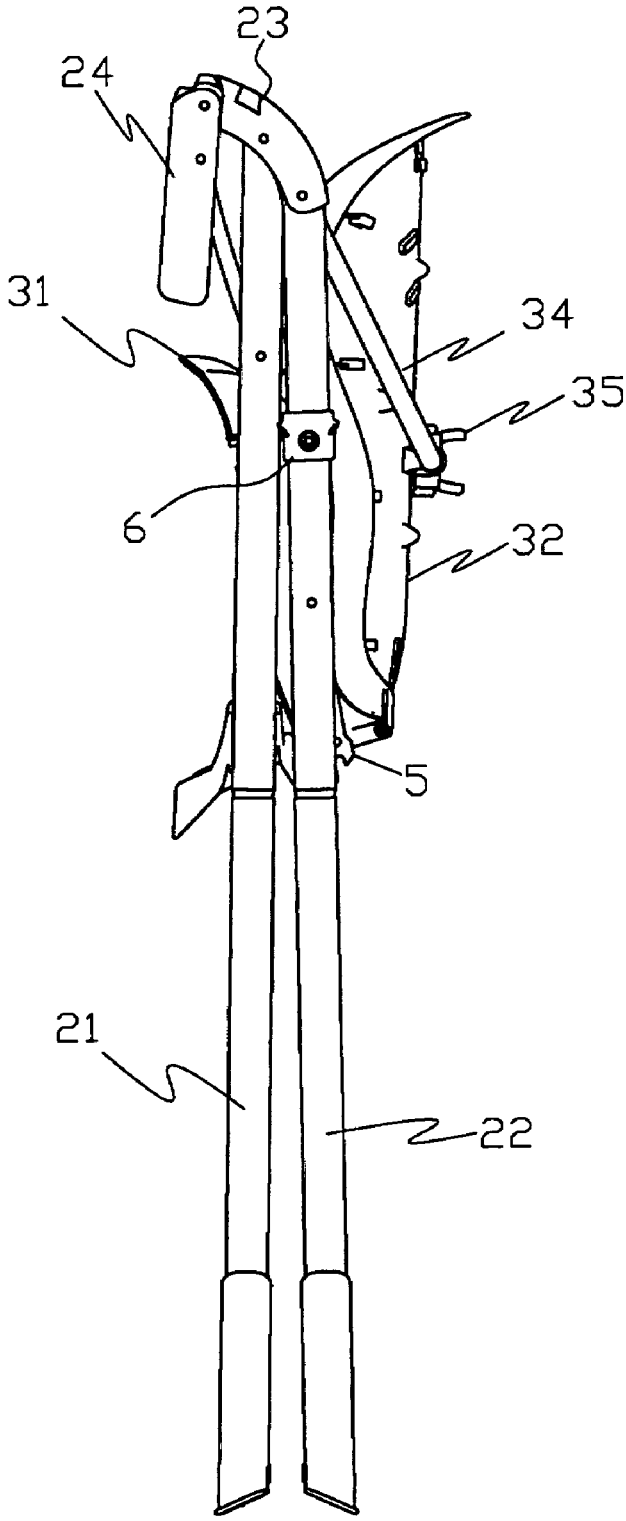
FIG. 6 is a schematic view showing the foldable structure of the present invention after folding.

Said folding sleeve 6 comprising an operator 1 is arranged at the slot 221 of the rear leg 22. The folding sleeve 6 reciprocates within the slot 221 of the rear leg 22 by a flexible member. As shown in FIG. 3, the folding sleeve 6 has a locking block 22 arranged transversely. While expanding the structure 1, the locking block 22 is pushed into the locking portion 51 by the slope 52 of the linking rod 5; furthermore, the locking block 62 is retained inside the locking portion 51 by the flexible member 60 so as to restrain rotation of the linking rod 5 and fix the structure 1 while expanding. As shown in FIG. 4, when the user intends to fold the structure 1, the folding sleeve 6 is pulled via the operator 61 to allow the locking member 62 to disengage from the locking portion 51. Referring to FIGS. 5 and 6, via drawing close of the front and rear legs 21, 22, the linking rod 5 interlocks the seat portion 31 to rotate and collapse; meanwhile, the folding rod 25 interlocks the connecting base 24 to rotate downwardly to fold the tray 4. In addition, the backrest 32 is interlocked by the back supporter 34 and to draw close to the seat portion 31. As shown in FIG. 6, the present invention allows the user to expand or fold the structure 1 to be more compact for storage.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A foldable structure of highchair, comprising:

a foldable supporter, having a front leg, a rear leg and a pivoting base, wherein the pivoting base is pivotally connected to an upper part of the front and rear legs so that said front and rear legs are foldable toward each other;

a seat, having a seat portion and a backrest pivotally connected to each other, wherein the seat portion pivots about the front leg;

a back supporter is adjustably connected to the backrest and pivotally connected to the foldable supporter;

a linking rod, pivotally connected to the rear leg and connected to one side of the seat portion, interlocks the rear leg and the seat portion of the seat allowing said seat portion to rotate when said foldable supporter is folded or expanded, a locking portion is disposed at one end of the linking rod; and a folding sleeve, slidably mounted on the rear leg, having a locking block, wherein the locking block is lockable to the locking portion of the linking rod so as to allow the structure to be locked in an expanded position; while folding the structure, the locking block disengages from the locking portion so as to allow the foldable supporter and the seat to be folded via interlocking of the linking rod.

2. A foldable structure as claimed in claim 1, wherein a transverse rod is connected between two sides of the front leg and one side of the seat portion pivotally rests on the transverse rod.

3. A foldable structure as claimed in claim 1, wherein a connecting base for receiving the tray is pivotally connected to said pivoting base.

4. A foldable structure as claimed in claim 3, wherein a folding rod is pivotally connected to the connecting base and the front leg so as to fold or collapse the tray by the folding rod.

5. A foldable structure as claimed in claim 1, wherein a backrest-adjusting device is disposed at the backrest.

6. A foldable structure as claimed in claim 5, wherein the back supporter pivots about the pivoting base of the foldable supporter in order to adjustably engage the backrest-adjusting device.

7. A foldable structure as claimed in claim 6, wherein the back supporter adjusts an angle of rotation via the backrest-adjusting device to control and support the inclination of the backrest.

8. A foldable structure as claimed in claim 1, wherein the locking portion is a notch.

9. A foldable structure as claimed in claim 8, wherein the notch is provided with a slope, which can push the locking block into the locking portion automatically.

10. A foldable structure as claimed in claim 1, wherein a flexible member retains the locking block automatically in a locked state with the locking portion.

11. A foldable structure as claimed in claim 1, wherein the folding sleeve is provided with an operator for holding in order to move the folding sleeve.

12. A foldable structure as claimed in claim 1, wherein the back supporter pulls the backrest to approach the seat portion while folding the structure.

* * * * *